United States Patent [19]

Ritter et al.

[11] Patent Number: 4,978,585

[45] Date of Patent: Dec. 18, 1990

[54] SILICON CARBIDE FIBER-REINFORCED TITANIUM BASE COMPOSITES OF IMPROVED TENSILE PROPERTIES

[75] Inventors: Ann M. Ritter, Schenectady; Paul A. Siemers, Clifton Park, both of N.Y.; Donald R. Spriggs, San Diego, Calif.

[73] Assignee: General Electric Company, Schenectady, N.Y.

[21] Appl. No.: 459,894

[22] Filed: Jan. 2, 1990

[51] Int. Cl.[5] ..... B05D 1/10; B32B 15/14; C22C 32/00; B22D 23/00

[52] U.S. Cl. ..... 428/614; 164/46; 164/461; 164/463; 427/34; 428/567; 428/568; 428/937

[58] Field of Search ..... 164/46, 131, 461, 463; 428/614, 567, 608, 937, 568, 569, 549, 553, 539.5; 427/34

[56] References Cited

U.S. PATENT DOCUMENTS

| | | | |
|---|---|---|---|
| 4,499,156 | 2/1985 | Smith et al. | 428/614 |
| 4,782,884 | 11/1988 | Siemers | 164/461 |
| 4,786,566 | 11/1988 | Siemers | 428/937 |
| 4,805,294 | 2/1989 | Siemers | 164/46 |
| 4,838,337 | 6/1989 | Siemers | 164/46 |

*Primary Examiner*—Theodore Morris
*Assistant Examiner*—David W. Schumaker
*Attorney, Agent, or Firm*—Paul E. Rochford; James C. Davis, Jr.; James Magee, Jr.

[57] ABSTRACT

A method of altering the crystal form of an alloy is disclosed. To accomplish this change in crystal form, the concentrations of the more volatile constituents of the alloy are reduced and the concentration of the less volatile constituents is increased on a relative basis. The process may be carried out in forming a reinforced structure. For this purpose, an improved reinforced matrix and a method of forming it are taught. The reinforcement may be silicon carbide filaments or other reinforcing filaments. The matrix is a titanium 1421 alloy nominally containing 14 weight percent of aluminum and 21 weight percent of niobium. The matrix is formed by plasma-spray forming a powder of the alloy to impart to the alloy particles a superheat during the plasma-spraying as the particles traverse the plasma plume. As a result of the superheat, the alloy is changed in its composition to reduce the aluminum concentration and to increase the niobium and titanium concentrations on a relative basis. As a result of the change in composition the crystal form of the spray deposited matrix is altered to increase the amount of the beta-phase crystal form of the alloy which is present and to decrease the amount of the alpha-2 crystal form of the alloy which is present. The result is the formation of a matrix which is less subject to cracking and which has greater strength.

7 Claims, 4 Drawing Sheets

SILICON CARBIDE FIBER-REINFORCED TITANIUM BASE COMPOSITES OF IMPROVED TENSILE PROPERTIES

CROSS REFERENCE TO RELATED APPLICATIONS

The present invention relates generally to application Ser. No. 445,203 (attorney docket RD-19,029) filed Dec. 4, 1989; application Ser. No. 455,048 (attorney docket RD-19,393); and to Ser. No. 455,041, (attorney docket RD-19,287) both filed Dec. 22, 1989. These related applications are incorporated herein by reference.

BACKGROUND OF THE INVENTION

The present invention relates generally to composites having a titanium base matrix reinforced by silicon carbide fiber or filament reinforcement. More particularly, it relates to improvements in the matrix components of a silicon carbide reinforced titanium aluminide composite.

The preparation of titanium alloy base foils and sheets and of reinforced structures in which silicon carbide fibers are embedded in a titanium base alloy are described in the patents: U.S. Pat. Nos. 4,775,547; 4,782,884; 4,786,566; 4,805,294; 4,805,833; and 4,838,337; assigned to the same assignee as the subject application. The texts of these prior art patents are incorporated herein by reference. The preparation of these composites is the subject of intense study inasmuch as the composites have very high strength property in relation to their weight. Prior to the development of the processes described in the above-referenced patents, such structures were prepared by sandwiching the reinforcing filaments between foils of titanium base alloy and pressing the stacks of alternate layers of alloy and reinforcing filament until a composite structure was formed. However, that prior art practice resulted in some misalignment of the reinforcing fibers.

The structures taught in the above-referenced patents greatly improved over the earlier practice of forming sandwiches by compression.

It has been found that while the structures prepared as described in the above-referenced patents have properties which are a great improvement over earlier structures, the attainment of the potentially very high ultimate tensile strength in these structures did not measure up to the values theoretically possible.

The testing of composites formed according to the methods taught in the above patents has demonstrated that although modulus values are generally in good agreement with the rule of mixture predictions, the ultimate tensile strength is usually much lower than predicted by the underlying properties of the individual ingredients of the composite. Further, testing has shown that the total strain to composite fracture is relatively low and, in addition, extensive off-plane cracking of the matrix has been observed It has been found that the matrix in composites formed with SiC reinforcement in a Ti-1421 matrix consist primarily of alpha-2 crystal form which is an ordered intermetallic phase and the secondary constituent of the matrix is small amounts of beta-phase. The alpha-2 crystal material tends to have low ductility and envelopes of this phase, which tend to form around the SiC fibers, have been found to crack during consolidation.

From observations and analysis that has been made, it appeared that modification of the phase distributions which the alloy forms in the matrix could contribute toward inhibiting matrix cracking and could result in property improvement. From our study it appeared that such property improvement might be achievable by modification of the plasma processing used in forming the matrix of the composite structure.

BRIEF STATEMENT OF THE INVENTION

It is, accordingly, one object of the present invention to improve the properties of filament reinforced titanium base matrix composites.

Another object is to provide a method which permits improvements to be made in the matrix of reinforced composites having titanium base matrices.

Another object is to provide a convenient control for optimizing the properties of a matrix of a composite having a titanium base alloy matrix.

Other objects will be in part apparent and in part pointed out in the description which follows.

In one of its broader aspects, objects of the present invention can be achieved by

- providing a plurality of strands of a reinforcing silicon carbide,
- plasma-spray depositing onto said strands a titanium aluminide of a desired atomic ratio of titanium to aluminum, and
- adjusting the plasma parameters used in said plasma-spray deposit process to increase the superheat of particles melted in transit through the plasma, and to thereby increase the ratio of the beta-phase crystal form in said deposit

BRIEF DESCRIPTION OF THE DRAWINGS

The description which follows will be understood with greater clarity if reference is made to the accompanying drawings in which.

DETAILED DESCRIPTION OF THE INVENTION

Figure 1:
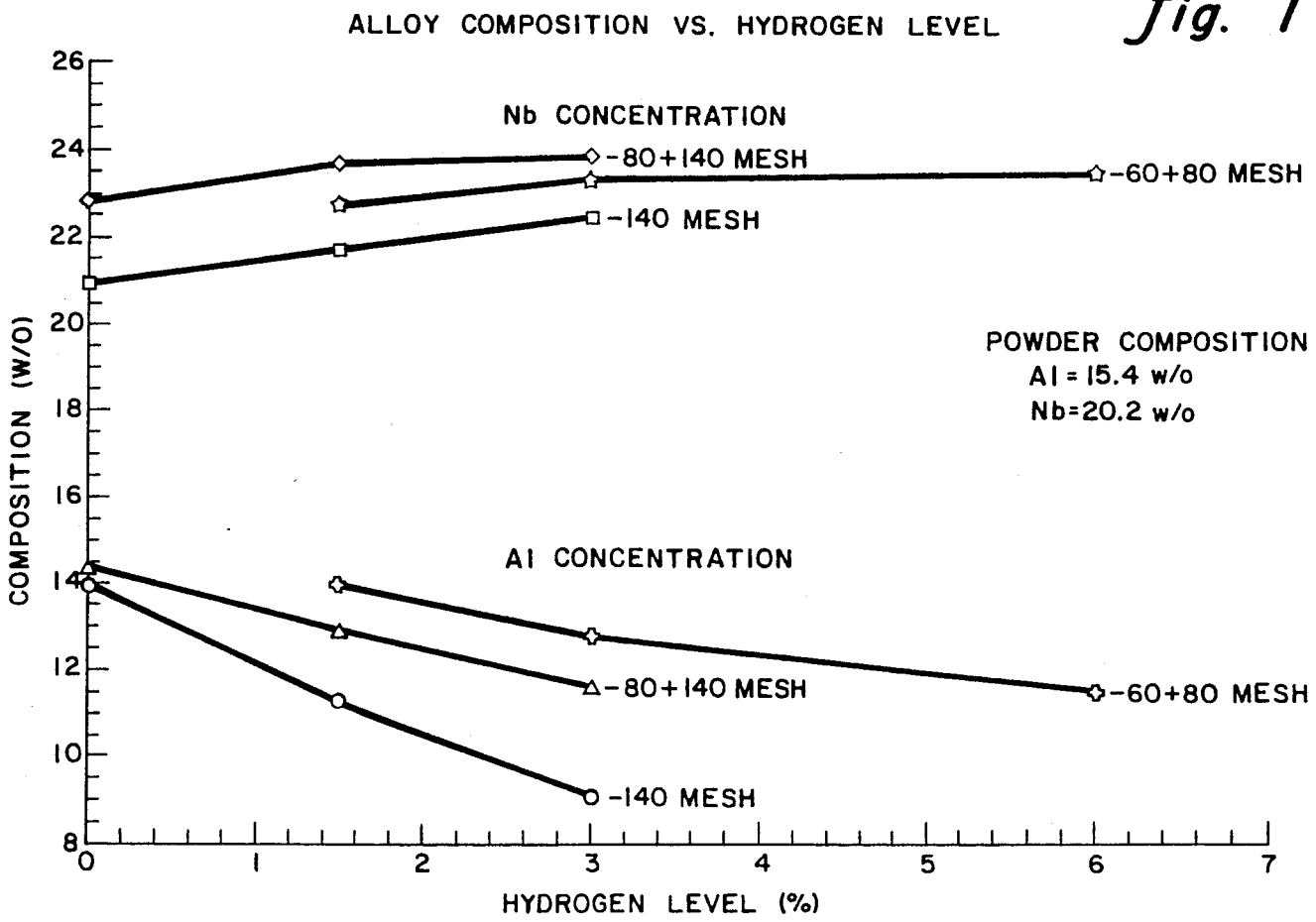
FIG. 1 is a graph in which the composition in weight percent is plotted against hydrogen level in percent.

It has been observed as is noted above that the alloy Ti-1421, which consists nominally of 14 weight % aluminum and 21 weight % of niobium in a titanium base, tends to form the alpha-2 crystal form with a minor amount of beta-phase crystal form. We have observed that the beta form of the alloy is preferable in some of the properties it exhibits including greater room temperature ductility and lesser tendency to form cracks. Composite structures having silicon carbide fiber reinforcement and Ti-1421 matrix have been formed using plasma-spray techniques such as those described in the six patents referenced in the background statement above.

Surprisingly, we have now found that by modification of the plasma-spray processing, it is possible to significantly increase the concentration of the beta constituent in the spray deposited Ti-1421. In this connection, we have found that a large amount of beta phase will be present in the consolidated composite if a controlled amount of aluminum is vaporized from the Ti-1421 alloy during the plasma deposition.

The volatilization of the aluminum is achieved through varying the degree of superheat in the molten Ti-1421 powder. The degree of superheat is modified principally by modifying the composition of the plasma gas to increase the amount of superheat which is imparted to particles of the Ti-1421 powder as it traverses the plasma flame.

The plasma processing of Ti-1421 alloy to convert the powder into a matrix may be carried out as described in the six patents referenced above in the background statement.

Further, the manner of modifying the plasma processing in order to decrease the concentration of aluminum in the deposited alloy is discussed in copending application Ser. No. 445,205 (attorney docket RD-19,029), filed Dec. 4, 1989, the text of which is also incorporated herein by reference. As is explained in this copending application, one way in which the superheat of a powder being plasma processed may be increased is by altering the concentration of hydrogen in the plasma gas. Surprisingly, we have found that when the Ti-1421 alloy is processed with higher concentration of hydrogen gas in the plasma gas mixture, there is not only a greater tendency toward the evaporation of aluminum but very surprisingly there is in addition a greater tendency toward the formation of the beta-phase crystal form of the alloy. This was an unexpected result.

What we have found unexpectedly is that the crystal form of the Ti-1421 alloy can be altered from its normal alpha-2 form to a beta form. Moreover, we have found that the alteration can be to a small degree or to a larger degree depending on the plasma processing carried out. A high level of the beta-phase form or an intermediate level of the beta phase form can be developed in the plasma deposited alloy depending on the degree of superheat developed in the particles traversing the plasma flame and correspondingly the level of beta-phase crystal form of the deposited alloy. We are not sure why the Ti-1421 alloy undergoes the change in crystal form which we have observed but we know that the change does take place and that the change is a beneficial result.

A number of tests of the method of preparing filament reinforced titanium base matrix composites were carried out. In these tests, the volume fraction of silicon carbide reinforcement were held approximately constant but the percent hydrogen in the plasma gas was varied as set out in Table I immediately below.

TABLE I

Room Temperature Longitudinal Tensile Data for Plasma-Sprayed Ti-1421/SCS-6

| RF No. | % Hydrogen | V.F. SiC | 0.02% Y.S. | U.T.S. | Total Strain | Modulus |
|---|---|---|---|---|---|---|
| 764 | 0% | 0.30 | 87 ksi | 136 ksi | 0.66% | 28.1 Msi |
| 820 | 0 | 0.33 | 90 | 211 | 1.02 | 30.3 |
| 820 | 0 | 0.33 | 86 | 197 | 0.98 | 29.6 |
| 822 | 1.5 | 0.33 | 91 | 234 | 1.17 | 29.2 |
| 822 | 1.5 | 0.33 | 90 | 248 | ≧1.17 | 31.8 |
| 823 | 3.0 | 0.34 | 98 | 239 | 1.13 | 30.5 |
| 823 | 3.0 | 0.34 | 94 | 258 | 1.22 | 31.3 |

From the data presented in Table I, it is evident that the concentration of hydrogen was varied from zero % to 1.5% and then to 3%. The volume fraction of silicon carbide reinforcing fiber was essentially constant for the last six of the compositions listed in the table. It will be observed that the yield strength increased on average as the concentration of hydrogen in the plasma gas increased. Similarly, the ultimate tensile strength increased appreciably as the concentration of hydrogen was increased.

It has been found that the percent of hydrogen in the gas does affect the degree of superheat developed in the alloy particles processed through the plasma flame. The base gas used in this plasma processing was ⅔ helium and ⅓ argon. However, it is the addition of the small concentration of hydrogen to the base gas which controls the superheating of the particles. This correlation between hydrogen gas concentration and superheat, and the corresponding correlation between hydrogen gas concentration and the degree of beta-phase crystal form in the deposited alloy provides the practicer of this invention with a very effective, though unexpected, tool for controlling the degree of beta-phase crystal from developed in the deposited Ti-1421 alloy.

Determinations were made of the concentration of the aluminum in the plasma deposited Ti-1421 alloy relative to the concentration of hydrogen in the plasma gas. The data collected is for a number of different sets of powders having different initial concentrations of aluminum and niobium and also having different particle sizes. The data collected from these several tests and studies are plotted in FIG. 1, as the significance of the changes in values becomes additionally clear from the plotted version of the data.

As is evident from the data, as plotted on FIG. 1, the aluminum concentration changed for alloys having initial aluminum concentrations in the range of about 14%. The initial concentration was reduced by the plasma-spraying process and the degree of reduction related to both the hydrogen level in the plasma gas and to the mesh size of the particle of the powder which was plasma-spray deposited. It is evident that reduction in aluminum concentration increased with increasing hydrogen concentration up to about 6%. Also, the degree of change of aluminum concentration in the Ti-1421 alloy increased with the decreasing particle size of the powder which was plasma-spray deposited.

Figure 2:
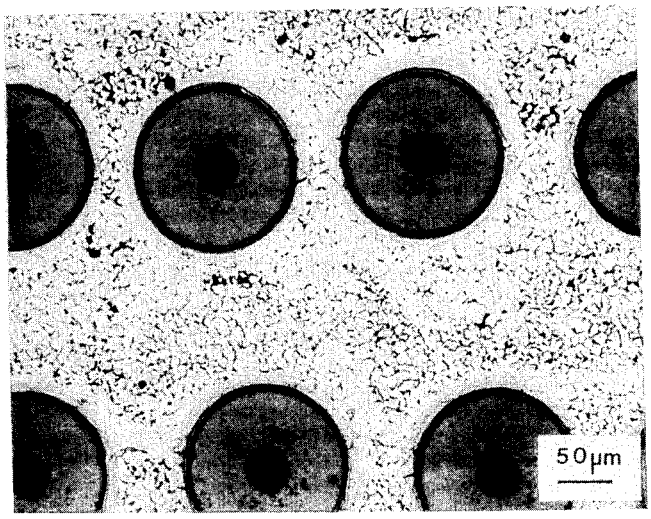
FIGS. 2, 3, and 4 are micrographs of silicon carbide reinforced titanium aluminide.
Figure 3:
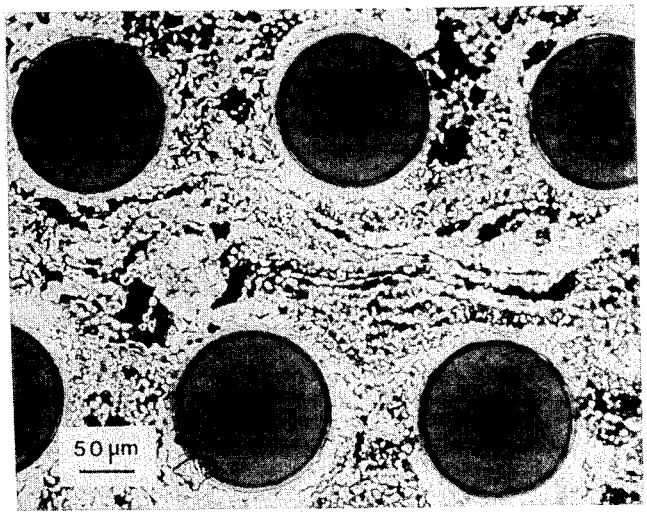
Figure 4:
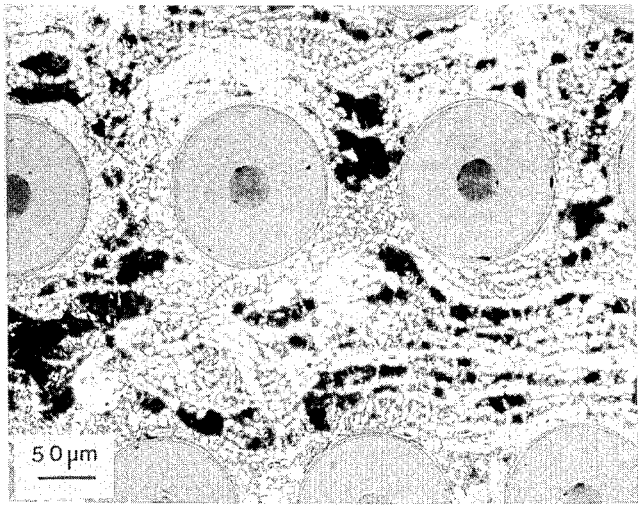

However, the real significance of the changes which occurred in the deposited matrix is not revealed as much from the graph of FIG. 1 as it is from the micrographs of FIGS. 2, 3, and 4. Each of the three micrograph figures is on the same size scale as indicated by the 50 micron bar in the lower portion of the Figures. FIG. 2 is a micrograph of the reinforced matrix formed by plasma-spray deposit of Ti-1421 alloy using a plasma gas which was free of hydrogen. It will be observed that the alpha-2 matrix had quite small isolated regions of beta phase present in the matrix. FIG. 3 is a matrix similar to that of FIG. 2 but illustrating a micrograph of a reinforced matrix composition prepared by plasma-spray deposit and consolidation where the plasma gas employed contained about 1.5% hydrogen.

Turning next to FIG. 4, this figure illustrates a micrograph of a fiber reinforced matrix of Ti-1421 alloy where the matrix was deposited employing a plasma gas containing 3% hydrogen. The other constituents of the gas in each of the three examples was about ⅔'s helium and ⅓ argon.

It will be observed from FIG. 4 that there are large semicontinuous regions of the beta-phase or transformed beta-phase in the matrix formed with the plasma gas containing 3% hydrogen.

Also, by carefully observing each of the three micrographs, it is evident that the width of the alpha-2 envelopes surrounding the fibers decreased as the amount of beta phase in the matrix of the composite increased.

Some details of the processing are set out in the following examples:

EXAMPLES 1-3:

A sample of Ti-15Al-21Nb powder, where the composition is in weight %, was produced by the plasma rotating electrode process. The powder thus obtained was sieved and the −80+140 size fraction (105–177 micron) was used for the plasma deposition study. Three separate plasma-spray deposits of the Ti-15Al-21Nb powder were made. In these three runs, the hydrogen level of the plasma gas was respectively: 0, 1.5, and 3%. A receiving surface was first prepared by winding silicon carbide fibers, obtained from Textron Specialty Materials Company and identified as SCS-6 fibers, to a steel drum. The powder was plasma-sprayed onto the steel drum to form a matrix about the fibers and to constitute a monotape. A set of four such monotapes were prepared for each of the different plasma gases. The separate sets of four plys of monotape were separately HIPed together at 1,000° C. for three hours at 15 ksi pressure.

The reinforced composite plasma sprayed structures thus formed contained 33–34 volume % of the silicon carbide reinforcement. Three such plates were prepared for the plasma gases containing 0, 1.5, and 3% hydrogen. Microstructures of these plates were studied and micrographs of these structures were prepared and are the micrographs of the FIGS. 2, 3, and 4. As noted above, the least amount of beta-phase or transformed beta-phase (the dark etching phase) was present in the 0% hydrogen plate and the highest amount of beta-phase or transformed beta-phase was present in the 3% hydrogen plate. The 1.5% hydrogen plate contained an intermediate quantity of beta phase or transformed beta-phase.

Tensile samples were prepared from each of the plates and were tested at room temperature with the applied stress parallel to the fiber axis. The data obtained is included in the Table I above. Also included in the table are results from another low-beta-phase plate (RF-764) which was prepared by plasma-spraying with zero % hydrogen, and fabricated using the same conditions as described above.

Figure 5:
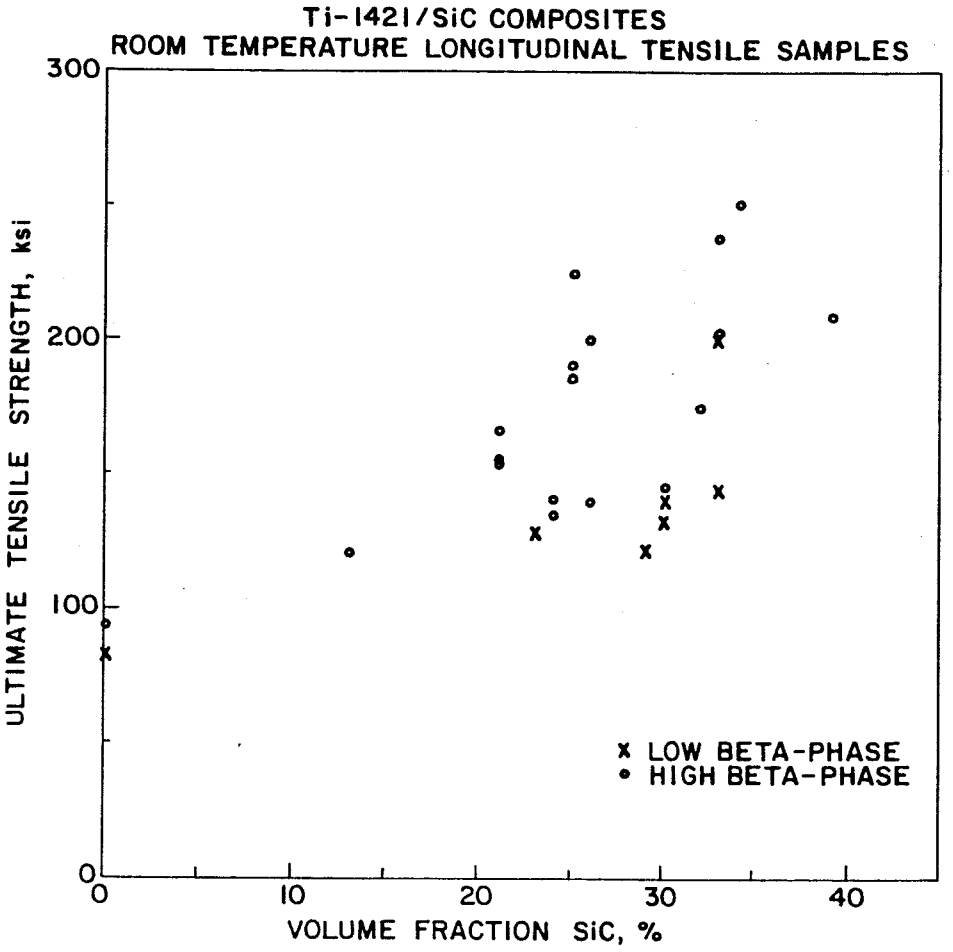
FIG. 5 is a graph in which ultimate tensile strength is plotted against volume fraction of silicon carbide in percent.

As an over-all observation, it is concluded that the plates containing the higher concentrations of the beta-phase tend to be stronger and to have higher fracture strains than the plates made with the low-beta-phase matrices. The relative strength of the high-beta-phase and low-beta-phase composites is shown in FIG. 5. FIG. 5 is a plot of the ultimate tensile strength in ksi against the volume fraction of silicon carbide in the structure stated in volume percent. It is evident from the results plotted in FIG. 5 that the plates prepared by the method of this invention for high-beta-phase specimens, as described above and as set forth in the Examples, have the best set of over-all properties of structures prepared by methods producing high-beta-phase composites and low-beta-phase composites.

Further, an examination of metallographic sections of the tensile samples show that there were many continuous matrix cracks in the low-beta-phase plates but only short cracks in the high-beta-phase plates.

On an over-all basis, the results obtained and described and plotted in this specification and drawings demonstrate that the microstructure modifications of the matrices of composite structures containing the Ti-1421 alloy are related to the enhanced properties of the high-beta-phase and to the improvements in composite fracture mode.

What is claimed is:

1. A method for forming a reinforced composite member which comprises providing a set of reinforcement strands, mounting said strands on a substrate to receive a plasma-sprayed matrix, providing a powdered sample of Ti-1421 alloy, plasma-spray depositing said powder onto said strands and onto said substrate with an RF plasma gun to form a matrix of Ti-1421 alloy, and modifying the aluminum concentration of said Ti-1421 alloy as it is being plasma-spray deposited by increasing the superheat of the particles of said alloy as the particles traverse the plume of said RF plasma thereby increasing the amount of beta crystal phase in the deposited matrix.

2. The method of claim 1, in which the plasma gas contains up to 6 volume percent hydrogen.

3. The method of claim 1, in which the plasma gas contains up to 3 volume percent hydrogen.

4. The method of claim 1, in which the plasma gas contains about 1.5 volume percent hydrogen.

5. The method of claim 1, in which the superheat is increased by reducing the particle size of the powder being plasma sprayed.

6. As an article of manufacture, a fiber reinforced metal monotape which comprises, a plurality of silicon carbide filaments, said filaments having disposed thereabout a plasma spray deposited Ti-1421 alloy, and said alloy displaying a higher percentage of beta crystal form than normal plasma spray deposited Ti-1421 such that there are larger semicontinuous regions of the beta-phase or transformed beta-phase in the matrix.

7. The monotape of claim 6, in which the filaments are axially aligned.

* * * * *